United States Patent [19]

Duchesne et al.

[11] 4,396,032

[45] Aug. 2, 1983

[54] SAFETY UNDERWATER PRESSURE REGULATOR

[75] Inventors: Claude A. Duchesne, Redondo Beach; Mark D. Johnson, Playa Del Rey, both of Calif.

[73] Assignee: Pittman Products, Inc., Huntington Park, Calif.

[21] Appl. No.: 252,617

[22] Filed: Apr. 9, 1981

[51] Int. Cl.[3] ..... B63C 11/22

[52] U.S. Cl. ..... 137/81.2; 137/71; 128/204.29

[58] Field of Search ..... 137/505.25, 71, 81.2; 128/204.26, 204.29, 205.24

[56] References Cited

U.S. PATENT DOCUMENTS 3,776,251 12/1973 Trubman ..... 137/71
3,926,211 12/1975 MacLardy ..... 137/505.25
4,230,140 10/1980 Hart ..... 137/81.2

FOREIGN PATENT DOCUMENTS 2756727 6/1979 Fed. Rep. of Germany ..... 137/71

*Primary Examiner*—A. Michael Chambers
*Attorney, Agent, or Firm*—Matthew P. Lynch

[57] ABSTRACT

Provided is an underwater pressure regulator comprising a high and a low pressure chamber, an inlet to the high pressure chamber and at least one outlet port associated with the low pressure chamber. A valve assembly including a valve seat is interposed between the high and low pressure chambers to control the flow of air between the chambers. A coil spring maintains the valve in open position when pressure in the low pressure chamber decreases. An oil reservoir responds to ambient water pressure via a flexible diaphragm to maintain the outlet pressure, i.e., the secondary pressure at a constant level above the ambient pressure at different depths. A piercing member serves to perforate the diaphragm upon excessive expansion of the latter due to high pressure leakage within the regulator system, oil being discharged, under pressure, through the perforated diaphragm, whereupon the regulator then becomes a conventional water-filled unit.

13 Claims, 2 Drawing Figures

SAFETY UNDERWATER PRESSURE REGULATOR

BACKGROUND OF THE INVENTION

1. Field of the Invention

The invention, in general, relates to an underwater pressure regulator for divers and, more in particular, relates to a first stage, oil-filled pressure regulator which is sealed by an oil reservoir within the regulator system, the reservoir responding to water pressure via a rubber diaphragm which flexes in response to ambient water pressure and thereby adjusts the secondary pressure.

2. Description of the Prior Art

Conventional first stage regulators of the piston-type, typically, incorporate high and low pressure chambers and inlets and outlets associated with these chambers, the inlets being coupled to a tank and the outlets being connected to the second stage regulator. Conventional first stage regulators maintain the secondary pressure at a set level above ambient pressure by allowing water to flow into the regulator and act upon a moveable piston or diaphragm.

Although these first stage pressure regulators operate satisfactorily, they are prone to freezing and contamination of the moveable piston or diaphragm from adverse environmental conditions.

SUMMARY OF THE INVENTION

Object of the invention, therefore, is to overcome the aforementioned disadvantage encountered with prior art first stage pressure regulators.

According to the invention, this is accomplished by providing a novel, sealed, oil-filled, first stage pressure regulating system which, essentially, comprises a generally elongated regulator body having a high pressure inlet and a means for connecting said inlet to a high pressure source. The high pressure inlet supplies high pressure gas to a valve structure which regulates the low pressure chamber. Said low pressure chamber is generally centrally located at one end of the generally elongated regulator body, and provides several low, i.e., secondary pressure outlets. The valve structure is comprised of a coil spring disposed in a third chamber and acts upon the piston. The third chamber, in essence, functions as a reservoir filled with oil, the reservoir responding to ambient water pressure exerted thereon via a diaphragm at the opposite end of the regulator to adjust the pressure through the low pressure ports of the first stage regulator at different depths. A piercing structure is associated with the diaphragm to perforate the latter upon excessive expansion thereof due to high pressure leakage within the sealed pressure regulating body. The oil contained within the third chamber or reservoir, subsequently, is discharged, under pressure, from the regulator through the punctured diaphragm. This arrangement automatically converts the pressure regulator into a conventional water-filled system.

Further objects, advantages, and features of the invention will become apparent from the following description when taken in connection with the attached drawings, in which:

DESCRIPTION OF THE PREFERRED EMBODIMENT

Figure 1:
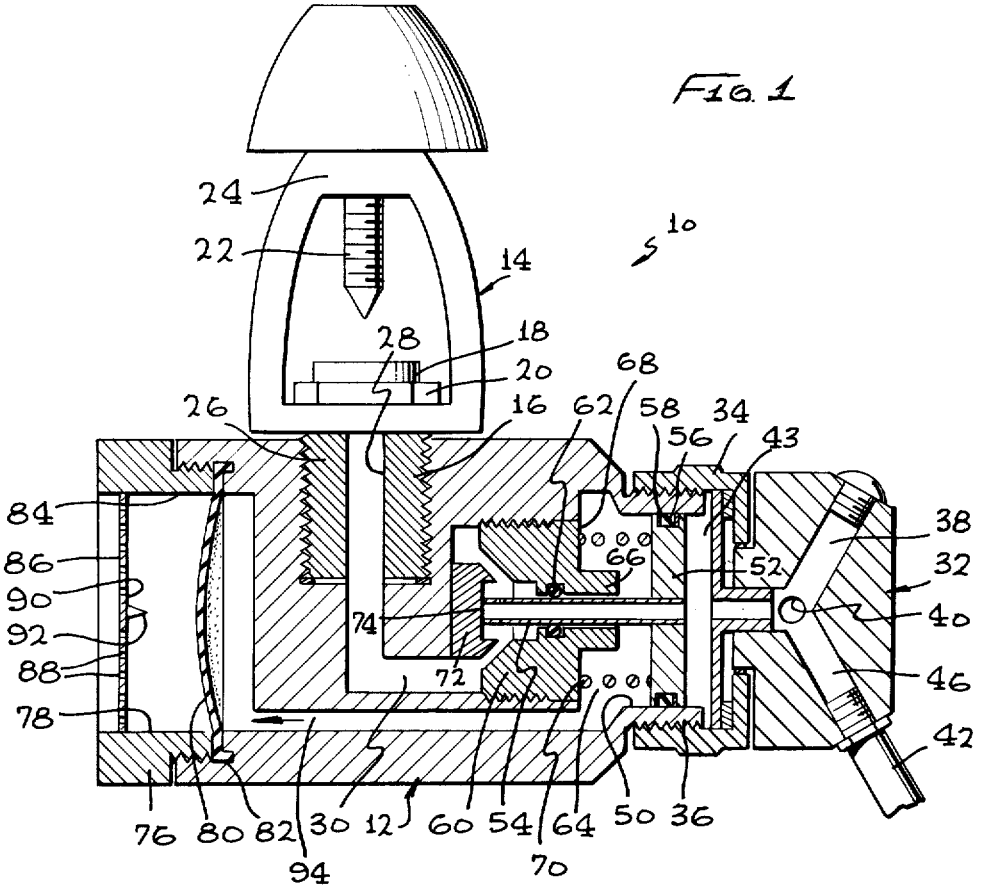
FIG. 1 is a cross-sectional view through the first stage pressure regulator according to the invention, illustrating the high and low pressure chambers and the valve assembly in closed position.

Referring now to the drawings in which like reference numerals index like parts, there is shown a first stage pressure regulator embodying the present invention and referenced generally by the numeral 10.

Regulator 10 is seen to comprise a generally elongated body or housing 12 having attached thereto a yoke 14. Yoke 14 is positionable in a desired orientation about an axis defined by an annular bolt member or stem 16, the latter being threadably received in the center structure of housing 12 and is formed with an exteriorly extending threaded portion 18 onto which the yoke is positioned by means of a nut or screw element 20. A manually rotatable yoke screw 22, FIG. 1, is threaded through the end 24 of yoke 14 to connect regulator 10 with a supply tank or bottle, not shown.

Annular internally received portion 26 of bolt 16, in the arrangement shown, is formed into the high pressure inlet of the regulator by passage 28. Passage 28 is connected to and communicates with the supply tank or bottle and extends axially inwardly to a high pressure chamber 30 within housing 12. Air or gas under high pressure flows from the tank or bottle through passage 28 into high pressure chamber 30.

One end of housing 12 is formed with a swivel cap 32. Swivel end cap 32 is rotatable relative to an internally threaded sleeve 34 position on an associated externally threaded portion 36 of housing 12 and at one end thereof. Typically, there are two or more low pressure ports, for instance ports 38, 40, in end cap 32 to allow suitable and convenient connections of a second stage hose connector, e.g., hose connector 42 threadably received in low pressure port 46.

Low pressure ports 38, 40, and 46 communicate with a low pressure chamber 43.

Figure 2:
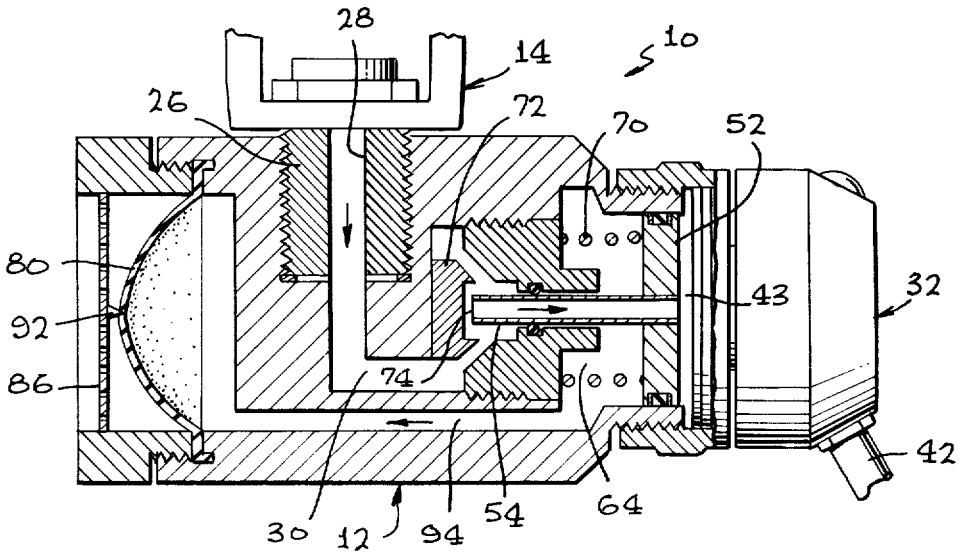
FIG. 2 is a view similar to FIG. 1, however, illustrating the diaphragm as being punctured due to high pressure leakage within the regulator system.

Externally threaded portion 36 has an inner passage extending axially inwardly into housing 12 and defining a bore 50 therein. Slidably mounted in passage or bore 50 is a diametrically enlarged annular outer end 52 of a "flow-through" valve member including an annular valve stem 54. Outer end 52 which functions as a piston, carries an O-ring sealing member 56 and an adjacent wiper ring 58 backing up the O-ring seal. Typically, piston 52 is made of stainless steel. O-ring 56 makes slidable frictional engagement with the sidewalls of bore 50, FIG. 2.

Valve stem 54 extends inwardly from oil-filled chamber 64 into high pressure chamber 30.

An annular metallic gland 60 is threadably mounted in housing 12 intermediate chambers 30 and 64 and in the plane of elongation of regulator 10.

The valve stem 54 slidably extends through gland 60. An O-ring 62 in the bore of gland 60 makes slidable frictional engagement with the outer periphery of valve stem 54, thereby forming a low pressure chamber 43 and ambient pressure chamber 64. Typically, the oil contained in chamber 64 is silicone oil.

The outer end 66 of gland 60 is of reduced diameter or stepped, and defines a shoulder 68 having a planar geometry.

Disposed between shoulder 68 of gland 60 and the piston 52 is a coil spring 70. Both ends of the spring 70 are preferably flattened so that they fit securely against the flat surfaces which they engage.

Positioned in high pressure chamber 30, generally centrally in housing 12, is a high pressure valve seat 72. Seat 72, typically, is reversible and replaceable. Valve seat 72 is disposed in an orientation transverse relative to the plane of elongation of valve stem 54, the latter having an end 74 adapted to engage valve seat 72 in the closed position of high pressure chamber 30, FIG. 1.

Regulator end 76 opposite swivel end cap 32, defines a hollow interior or bore 78. Disposed in bore 78 in a plane transverse to the elongation or longitudinal axis of regulator body 12 is a flexible circular diaphragm 80, typically of rubber. Diaphragm 80 seals chamber 64 and prevents the escape of oil therefrom. The peripheral edge portion 82 of diaphragm 80 is embedded in the surrounding inner wall 84 of hollow regulator end 76. Typically end 76 is threadably received in regulator body 12 and replacement of diaphragm 80 is accomplished by unscrewing or disengaging body end 76 from main regulator body 12. Diaphragm 80 is movable in back and forth direction in the plane of elongation regulator body 12.

A disk 86 is provided adjacent the end of inserted regulator end 76, in parallel relation with diaphragm 80. Disk 86 is formed with a plurality of perforations 88 which connect the interior or bore 78 of end 76 with the exterior ambient water. Provided centrally of disk 86 and on the inner surface 90 thereof, is a pointed projection 92, oriented in direction toward diaphragm 80. The pointed projection 92 serves as a piercing or puncturing element to perforate diaphragm 80 in case a high pressure leak occurs within the regulator system and in which condition the rubber diaphragm expands to a point where it forcibly engages the piercing projection 92. As a result of perforation of the diaphragm, the oil is expelled, under pressure, from chamber 64 and passage 94. Upon such release of the oil, the pressure regulator automatically converts into a conventional water filled system, allowing a diver ample time for a safe ascent.

The sealed, oil-filled regulator system is accomplished by the oil contained in the regulator responding to water pressure exerted onto diaphragm 80 via the perforations 88 in disk 86.

In operation, the coil spring 70 exerts pressure against piston 52 of the valve member. The pressure applied by coil spring 70 accordingly urges the valve stem 54 outwardly. This pressure is balanced against the pressure within low pressure chamber 43.

When the diver inhales, air or gas is drawn outwardly from the chamber 43 in response to demand from the second stage regulator, not shown. This reduces the pressure in low pressure chamber 43. The coil spring 70 will then move piston 52 a slight distance outwardly. This moves the inner end 74 of valve stem 54 away from valve seat 72 and permits air or gas to flow from high pressure chamber 30 into the exposed valve stem 54.

This flow of high pressure gas increases the pressure in low pressure chamber 43 and causes the piston 52 and, hence, valve stem 54 to move back inwardly to a position in which the valve stem end 74 is again seated against valve seat 72, in which condition the passage defined by valve stem 54 is closed off, FIG. 1.

It will be noted that exposure of diaphragm 80 through exposure to varying ambient pressures at different depth, flexes and acts to adjust the pressure in oil-filled chamber 64. Any change in pressure within chamber 64 increases or decreases the amount of pressure resisting inward movement of the outer end of piston 52 of the valve member. Hence, the oil responding to water pressure via diaphragm 80 which flexes in response to ambient water pressure, adjusts the pressure through the low pressure port or ports to the second stage.

High pressure leaks may, for instance, occur due to malfunctioning of O-ring sealing members 56 and 62 and the like.

While there has been shown and described a preferred embodiment of the invention, it should be understood that the same is susceptible of modification and change without departing from the spirit of the invention.

What is claimed is:

1. A safety pressure regulator comprising:

a main body having a high pressure chamber;

an inlet extending through said main body connecting with said high pressure chamber;

a low pressure chamber formed within said main body, an outlet port extending through said main body connecting with said low pressure chamber, said high pressure chamber communicating with said low pressure chamber;

a valve member intermediate said high pressure chamber and said low pressure chamber to regulate the flow of fluid from said high pressure chamber to said low pressure chamber, said valve member including a piston, said piston having an outer face and an inner face, said low pressure chamber connecting with said outer face of said piston, said piston being normally closed preventing flow of fluid from said high pressure chamber to said low pressure chamber;

a reservoir located within said main body, a liquid to be contained in said reservoir, said liquid being exposed to said innerface of said piston;

a flexible means mounted within said main body forming a wall surface for said reservoir, said flexible means being exposed to ambient water pressure and being deformable to decrease the volume of said reservoir and move said piston to permit flow of fluid from said high pressure chamber to said low pressure chamber; and piercing means mounted in said main body to puncture said flexible means upon excessive expansion thereof due to leakage of fluid from said high pressure chamber.

2. The pressure regulator of claim 1 wherein:

a valve stem attached to said piston, said valve stem having a hollow chamber, said hollow chamber providing for access of flow of fluid from said high pressure chamber to said low pressure chamber, the outer wall of said valve stem passing through a portion of said reservoir.

3. The pressure regulator as defined in claim 2 wherein:

said flexible means comprises a rubber diaphragm.

4. The pressure regulator as defined in claim 3 wherein:

said diaphragm being removably secured to said main body.

5. The pressure regulator as defined in claim 4 wherein:

said diaphragm being connected to said main body by a hollow end, said hollow end being threadingly secured to said main body, said hollow end being capable of tightly abutting against the peripheral edge of said diaphragm thereby holding such in place.

6. The pressure regulator as defined in claim 1 wherein:

said piercing means being in the form of a pointed needle-shaped element.

7. The pressure regulator as defined in claim 6 wherein:

a disk, said piercing means being mounted on said disk, said disk being formed with perforations enabling ambient water to contact said flexible means.

8. The pressure regulator as defined in claim 1 wherein:

said valve member being continuously biased to an open position to permit flow of fluid from said high pressure chamber to said low pressure chamber by a biasing means.

9. The pressure regulator as defined in claim 8 wherein:

said biasing means comprises a coil spring.

10. The pressure regulator as defined in claim 1 wherein:

said reservoir being isolated from said high and low pressure chambers and operationally independent thereof.

11. The pressure regulator as defined in claim 10 wherein:

said reservoir being filled with oil.

12. The pressure regulator as defined in claim 1 wherein:

a swivel cap connected to said main body at said low pressure chamber.

13. The pressure regulator as defined in claim 12 wherein:

said swivel cap being detachably secured to said main body.

* * * * *